US007938225B2

(12) United States Patent
Cardno

(10) Patent No.: US 7,938,225 B2
(45) Date of Patent: May 10, 2011

(54) CLEAN AIR DUCT NOISE SILENCING

(75) Inventor: Robert Cardno, Novi, MI (US)

(73) Assignee: DENSO International America, Inc., Southfield, MI (US)

( * ) Notice: Subject to any disclaimer, the term of this patent is extended or adjusted under 35 U.S.C. 154(b) by 63 days.

(21) Appl. No.: 12/349,317

(22) Filed: Jan. 6, 2009

(65) Prior Publication Data

US 2010/0170464 A1 Jul. 8, 2010

(51) Int. Cl.
*F02M 35/00* (2006.01)

(52) U.S. Cl. ..... 181/229; 123/184.53; 123/184.54; 123/184.61; 123/184.56; 123/184.57

(58) Field of Classification Search ..... 181/229; 123/184.21, 184.53, 184.56, 184.61
See application file for complete search history.

(56) References Cited

U.S. PATENT DOCUMENTS

| | | | | |
|---|---|---|---|---|
| 4,222,456 | A | 9/1980 | Kasper | |
| 4,339,918 | A | 7/1982 | Michikawa | |
| 5,632,145 | A | 5/1997 | Hunt | |
| 5,962,820 | A * | 10/1999 | LePoutre | 181/229 |
| 6,205,968 | B1 * | 3/2001 | Spannbauer | 123/184.57 |
| 6,267,006 | B1 * | 7/2001 | Bugli et al. | 73/114.34 |
| 6,715,580 | B1 * | 4/2004 | Gerstner et al. | 181/224 |
| 6,832,664 | B2 * | 12/2004 | Stuart | 181/240 |
| 6,938,601 | B2 * | 9/2005 | Fukumoto | 123/184.57 |
| 6,959,678 | B2 * | 11/2005 | Kino et al. | 123/184.53 |
| 7,621,372 | B2 * | 11/2009 | Yamaura et al. | 181/229 |
| 7,631,726 | B2 * | 12/2009 | McWilliam et al. | 181/258 |
| 2008/0264719 | A1 * | 10/2008 | Seko et al. | 181/229 |

* cited by examiner

*Primary Examiner* — Forrest M Phillips
(74) *Attorney, Agent, or Firm* — Harness, Dickey & Pierce, PLC

(57) ABSTRACT

An air intake system for reducing air induction noise, which includes an air duct housing that has a lower shell and an upper shell, each having a first end and a second end and a plurality of tuning holes formed therein. The air intake system further includes an air duct that is connected to the air duct housing and includes a circumferential wall having an interior surface and an exterior surface. The circumferential wall defines an aperture between a first end and a second end. A venturi is formed between the first and second ends and restricts the amount of sound passing from the first end to the second end of the air duct. The circumferential wall has a predetermined thickness that enables sound to pass through the circumferential wall and into the air duct housing.

19 Claims, 5 Drawing Sheets

CLEAN AIR DUCT NOISE SILENCING

FIELD

The present disclosure relates to vehicle air induction systems generally, and more particularly, to clean air duct noise silencing.

BACKGROUND

Reducing noise that may be heard by vehicle occupants is desirable to automotive manufacturers. The reduction in noise emanating from vehicle air induction systems has been accomplished through the application of specific technology to vehicles. One type of technology provides frequency cancellation through the application of components such as resonators, quarter wave tuners, non-reflective inlet ducts, expansion chambers, or diffusers, to the vehicle. These components are applied at various locations throughout the air induction system, for example, with certain limitations. As one example of these limitations, the clean air intake duct must remain sealed between the air cleaner box and the throttle inlet.

Diffusers and non-reflective ducts that have openings to the atmosphere are not available for installation in the clean air intake duct between the air cleaner box and the throttle inlet. Therefore, clean air duct tuning must be accomplished using resonators, expansion chambers, or quarter wave tuners. Each of these components requires additional packaging space in the engine compartment of the vehicle. It is desirable to provide acoustic tuning of the inlet duct without the use of additional components.

SUMMARY

An air intake system for reducing air induction noise may have an air duct housing with a lower shell and an upper shell. Each shell may have a first end and a second end and a plurality of tuning holes formed in the shells. The air intake system further includes an air duct that is connected to the air duct housing and includes a circumferential wall having an interior surface and an exterior surface. The circumferential wall defines an aperture between a first end and a second end and exhibits a predetermined thickness that enables sound to pass through the circumferential wall and into the air duct housing. A venturi is formed between the first and second ends and restricts the amount of sound passing from the first end to the second end of the air duct.

A first method of manufacturing an air intake system is presented and includes forming an air duct including a circumferential wall having an outer surface and an inner surface. The circumferential wall defines an aperture formed between a first and second end of the air duct. The circumferential wall has a first length, a first thickness, and a plurality of notches on the outer surface near the first and second end. The air duct is elongated before it cures so that the circumferential wall decreases to a second thickness that is less than the first thickness. Thereafter, one of the first and second ends of the air duct is rotated in a first direction to reduce the diameter of the air duct between the first and second ends. The air duct is positioned in a lower housing. Thereafter, an upper housing is attached to the lower housing.

A second method of manufacturing an air intake system includes forming an air duct having a circumferential wall including an outer surface and an inner surface, the circumferential wall defining an aperture formed between a first and a second end of the air duct, the circumferential wall having a first length and a first thickness. The air duct is elongated while in a semi-fluid state to decrease the thickness of the circumferential wall. The first end of the air duct is rotated in a first rotational direction while the second end of the air duct is rotated in the second rotational direction concurrent to the drawing to form a venturi portion between the first and second end of the air duct.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
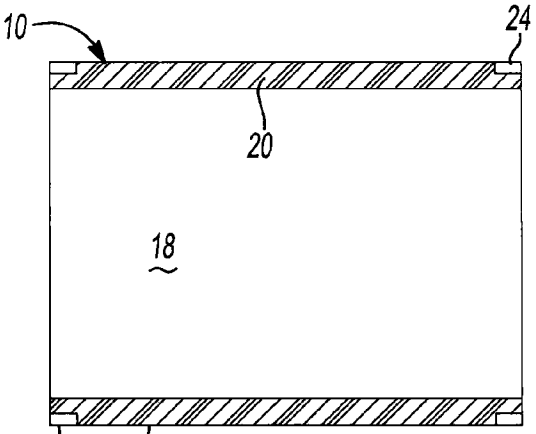
FIG. 1A is a cross-sectional side view of a molded air duct having a circumferential wall depicting the thickness of the circumferential wall before being elongated in accordance with the present teachings.
Figure 1:
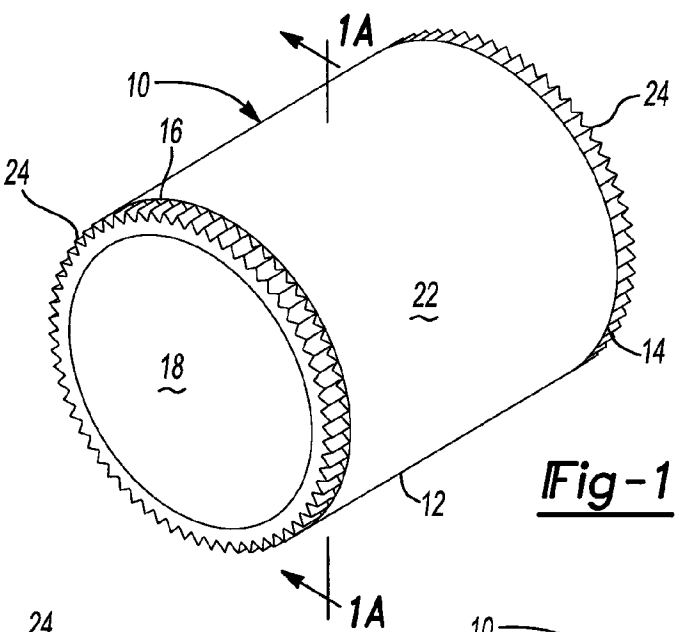
FIG. 1 is a partial perspective view of the air duct depicting a plurality of notches formed on the circumferential wall before being elongated in accordance with the present teachings.
Figure 2:
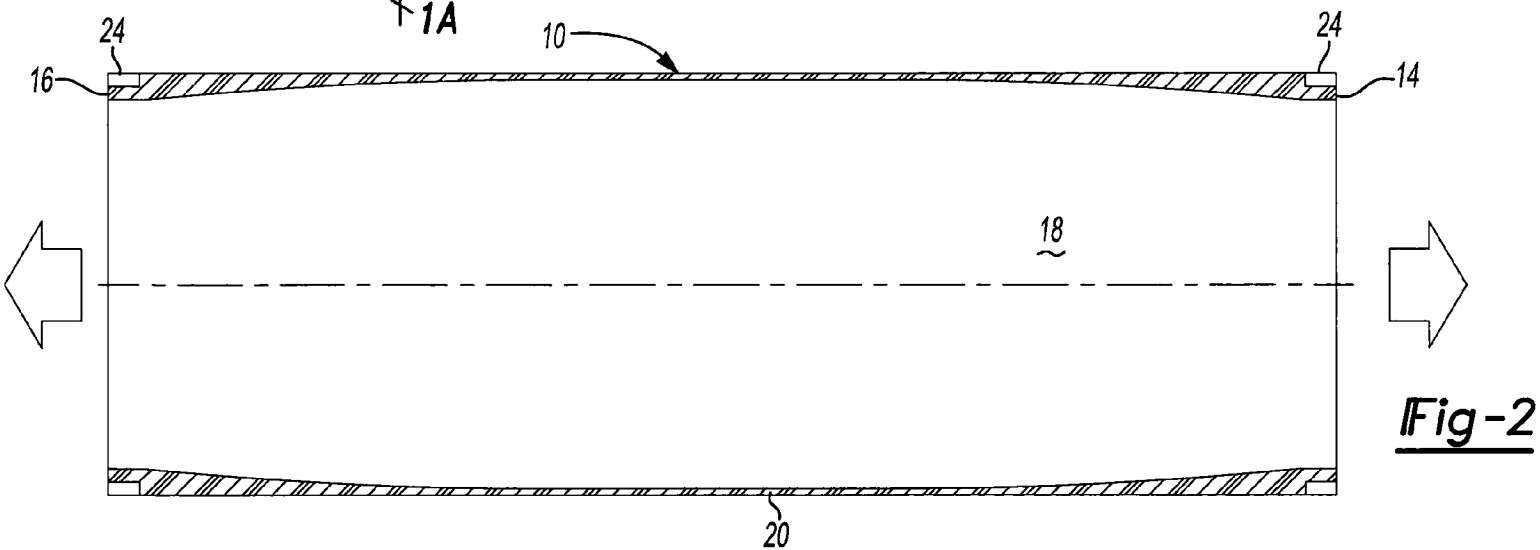
FIG. 2 is a cross-sectional side view of the air duct after being elongated in accordance with the present teachings.

Referring now to FIGS. 1 and 2, an air duct 10 may be formed from a non-porous material such as nylon or other flexible material, such as plastic, known in the art. A circumferential wall 12, with a first end 14 and a second end 16, may define an aperture 18 between the first and second ends 14, 16. The circumferential wall 12 may have a first predetermined thickness and a predetermined length. While the air duct 10 is curing, the first end 14 may be connected to a first tool (not shown) and the second end 16 may be connected to a second tool. As depicted with FIG. 1A, a middle portion 20 of the air duct 10 may then be elongated by pulling each of the ends 14, 16 in a direction away from the other, as depicted with arrows at each end of the air duct 10 in FIG. 2, in order to achieve a second predetermined thickness as also depicted in FIG. 2. The wall thicknesses at the center portions of the air duct 10, are depicted in a relative manner. That is, the wall thickness of the central portion of the air duct 10 of FIG. 1A is greater than the wall thickness depicted in the central portion of FIG. 2. Depending on the performance of the material chosen to form this part of the duct and its relative tendency to sag during this operation, the first tool and second tool may rotate at the same specific speed in order to limit the effects of gravity on the final shape.

Figure 5:
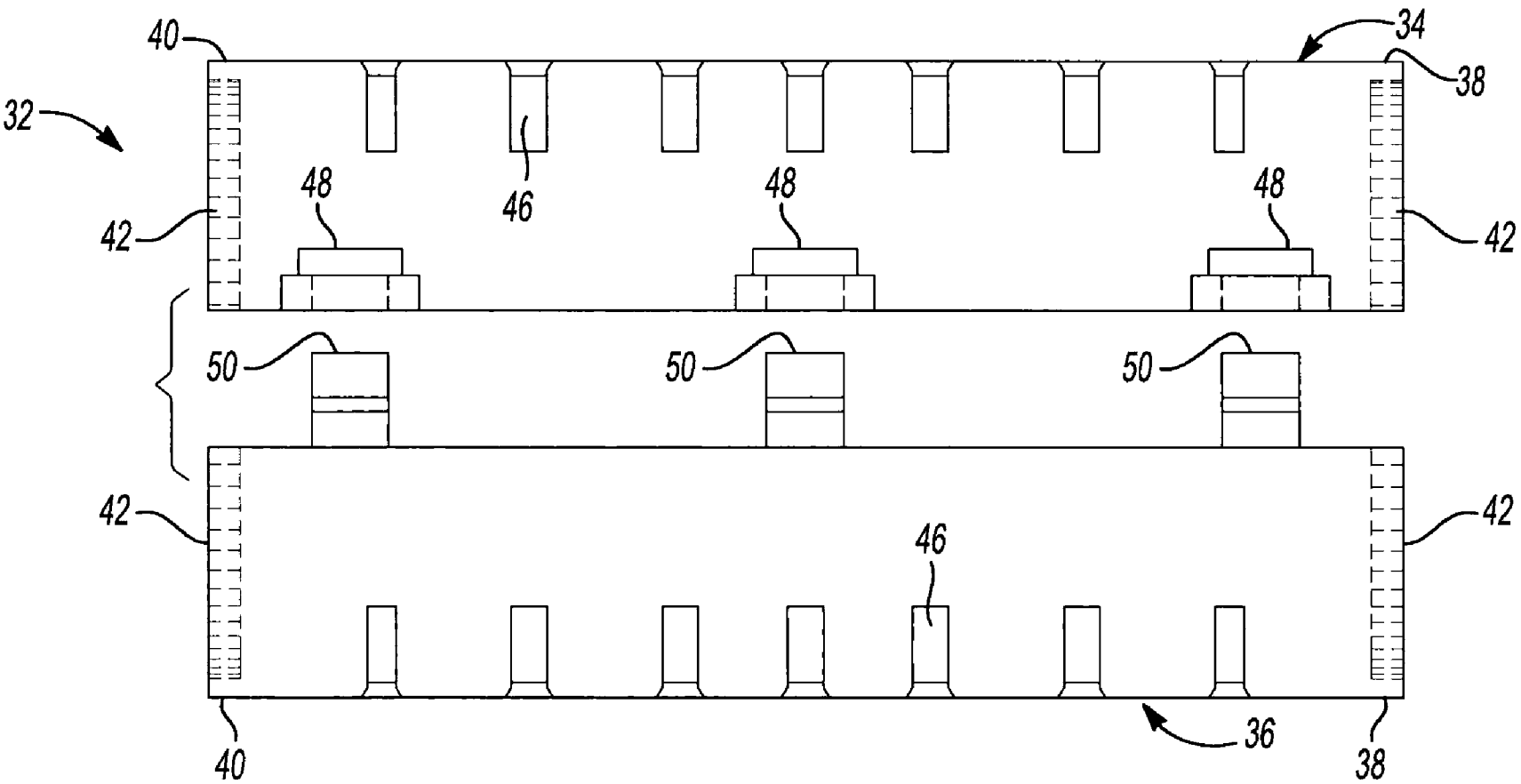
FIG. 5 is a side view of an air duct housing having an upper shell and a lower shell in accordance with the present teachings.

Continuing with reference to FIG. 2, the second predetermined thickness is much less than the first predetermined thickness to permit the circumferential wall 12 to move with the pressure waves caused by the air induction noise. The movement may be a flexing motion toward and away from a longitudinal central axis of the air duct 10, such as the axis depicted in FIG. 2. This movement allows the pressure waves to be absorbed and passed through the circumferential wall 12. The pressure waves can then be captured in an air duct housing 32 (FIG. 5). The air duct housing 32 can be tuned to allow a controlled dispersion of the pressure waves and thereby reduce air induction noise.

The circumferential wall 12 may have an outer surface 22. A plurality of notches 24 are formed around the circumferential wall 12 of the air duct 10 near the first and second ends 14, 16. The plurality of notches 24 or teeth prevent the first and second ends 14, 16 of the air duct 10 from rotating when attached to the air duct housing 32, which is depicted in FIG. 5. The first and second plurality of notches 24 can be molded concurrently with the air duct 10 or overmolded onto the air duct 10 after it is formed. As depicted in FIG. 5, the notches 24 may be located at the extreme ends of the housing 32, so that no other material of the housing 32 lies between either of the ends 14, 16 of the housing 32 and the notches 24.

Figure 3:
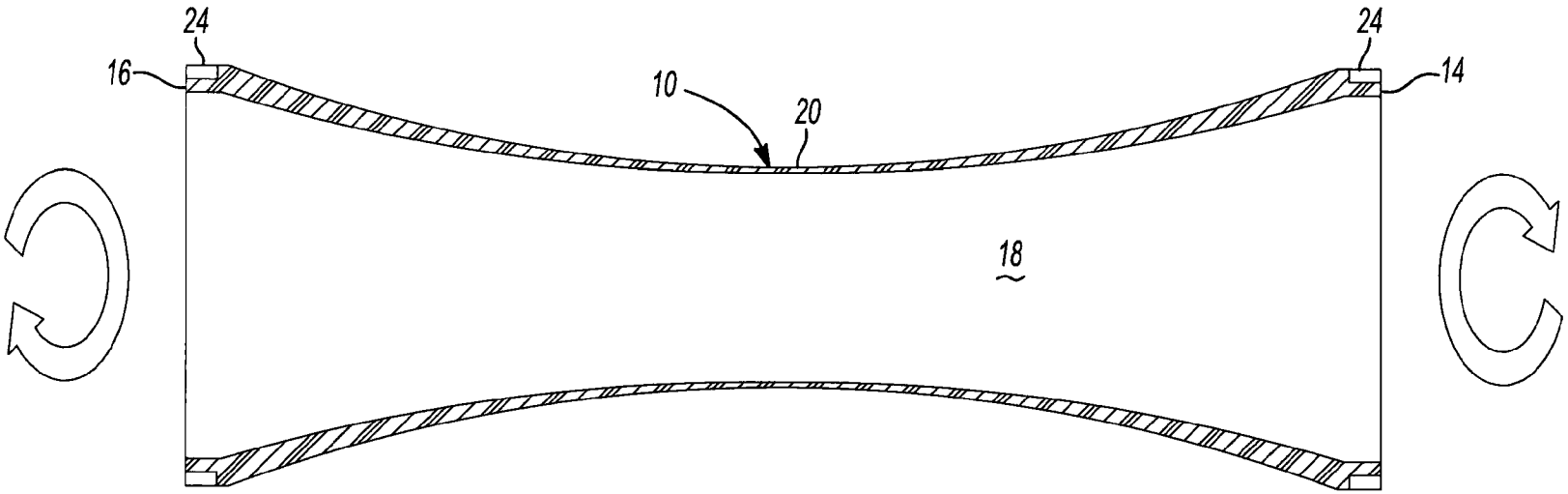
FIG. 3 is a cross-sectional side view of the air duct depicting the ends of the air duct being rotated in opposite directions in order to form a venturi in accordance with the present teachings.
Figure 4:
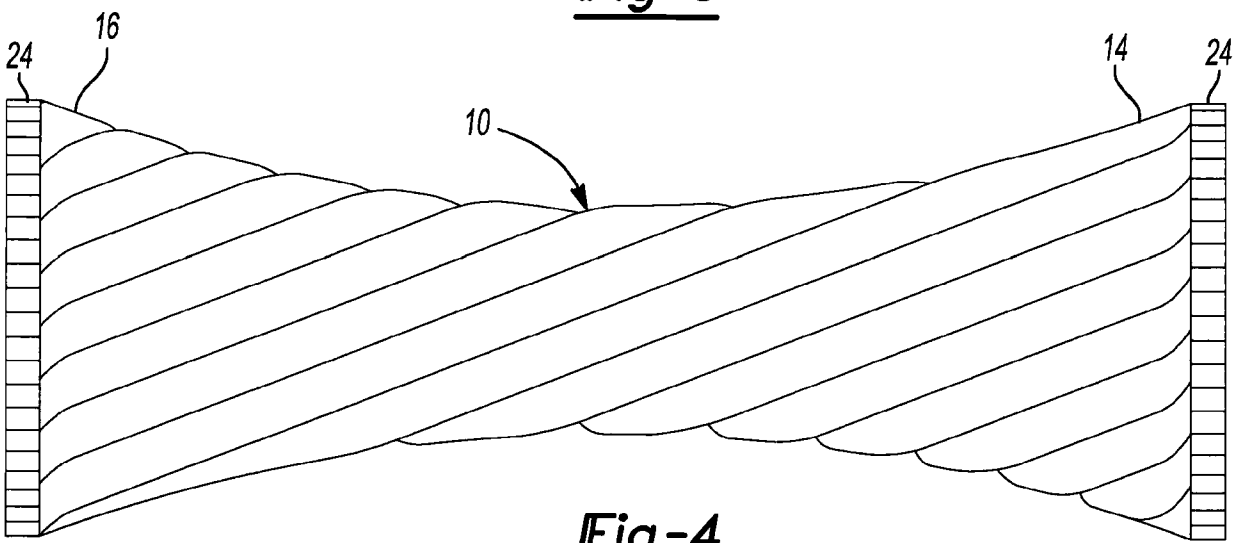
FIG. 4 is a side view of the air duct depicting the ends of the air duct being rotated a predetermined number of degrees in accordance with the present teachings.

With reference to FIG. 2, the middle portion 20 of the circumferential wall 12 is depicted having the second predetermined thickness after being elongated. In FIGS. 3-4, the first end 14 of the air duct 10 is depicted being wound or rotated a predetermined number of times in a first direction while the second end of the air duct 10 is rotated a predetermined number of times in a second, opposite direction. With the opposite twisting or turning of the ends, a venturi is created in the air duct 10 using the circumferential wall 12. Alternatively, one of the first and second ends 14, 16 of the air duct 10 can be held stationary while the other of the first and second ends 14, 16 is rotated a predetermined number of times to form the venturi. Further, if the first and second tools are rotating during the thinning of the material as described in above, then the rotation speed would begin to vary where either the first tool or second tool would increase or decrease its rotational velocity relative to other tool resulting in the venturi twist mentioned above.

The venturi creates a smaller diameter in the circumferential wall 12 between the first and second ends 14, 16 of the air duct 10. The effect of the smaller diameter is to create a smaller cross-section in the center (midpoint of the length) of the air duct 10. Because of the smaller diameter, the amount of noise energy that can pass through the air duct 10 is reduced than if a larger diameter duct were utilized. The inlet and outlet angles of the venturi can be designed to reduce air pressure losses that occur as air passes through the venturi. The most efficient inlet and outlet angles of a venturi can be determined through testing and simulation. The desired inlet and outlet angles can be achieved by controlling the amount of rotation and the rate of the rotation and the elongation. The venturi can be formed concurrently with the elongation process or performed subsequent to the elongation process, if desired. Forming the venturi concurrently with the elongation process can be shown to reduce the number of steps required to manufacture the air duct 10 as well as the cost and quantity of the tooling required to manufacture the air duct 10.

Figure 5B:
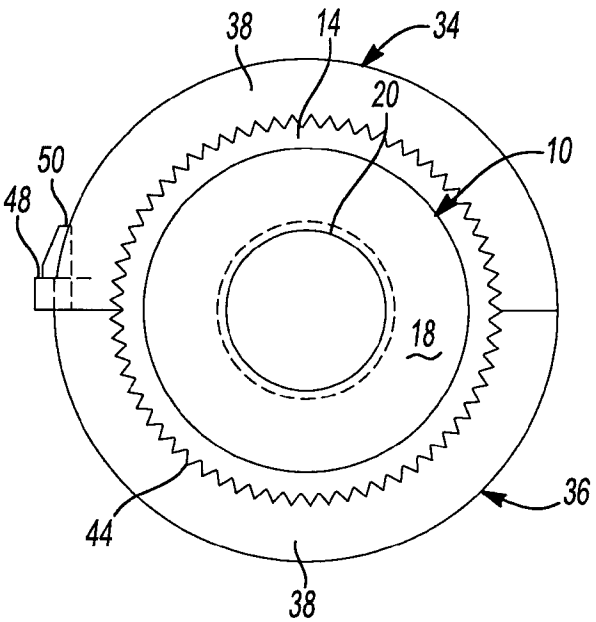
FIG. 5B is an end view of the air duct and air duct housing after assembly in accordance with the present teachings.
Figure 5A:
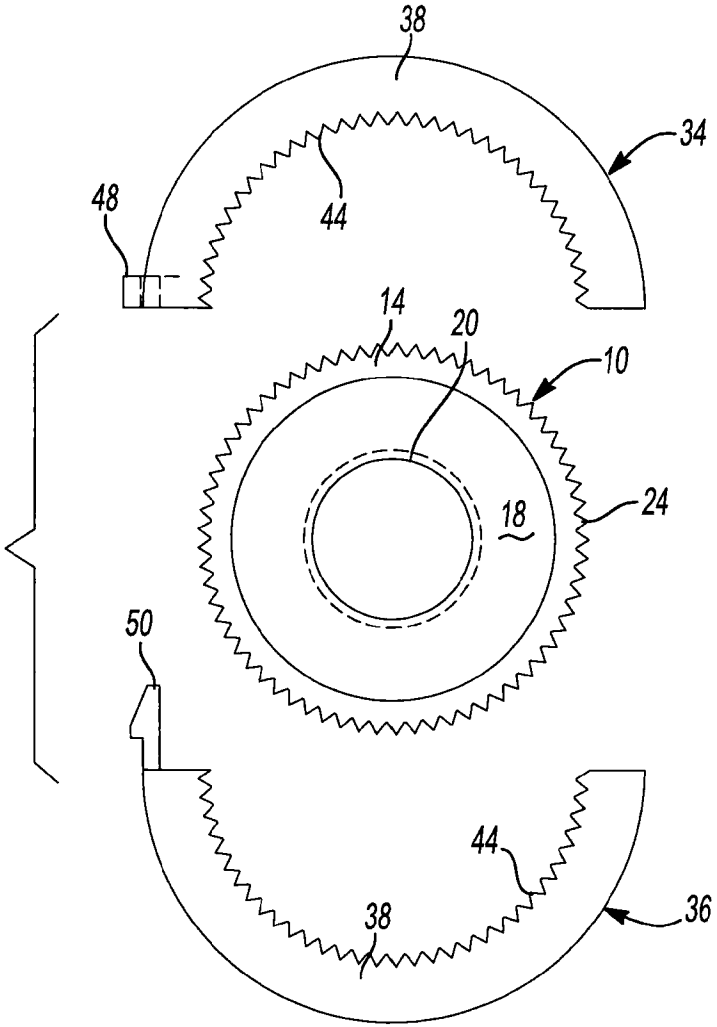
FIG. 5A is an end view of the air duct and the air duct housing before assembly in accordance with the present teachings.

With reference to FIGS. 5-5B, the air duct housing 32 includes an upper shell 34 and a lower shell 36 that have a substantially hollow cross-section. The upper shell 34 and lower shell 36 are used to house the air duct 10. and each have a first end 38 and a second end 40, with the upper shell 34 and lower shell 36 each defining an arcuate cut out portion 42. When the upper shell 34 and the lower shell 36 are connected together, the arcuate cut out portion 42 forms an aperture in the first ends 38 and the second ends 40 that may receive the air duct 10. The arcuate cut out portion 42 may have a shape that is similar to the circular shape of the circumferential wall 12 of the air duct 10. The arcuate cut out portion 42 may have a plurality of notches 44 or teeth formed thereon. The notches 44 may have substantially the same teeth or teeth-like shape, with ridges and valleys, as the notches 44 that are formed on the first end 14 and the second end 16 of the circumferential wall of the air duct 10 to enable the first end 14 of the air duct 10. This enables the first end 38 of the upper shell 34 and first end 38 of the lower shell 36 to interlock with each other as shown in FIG. 5B.

Similarly, the second end 16 of the air duct 10 and the second end 40 of each of the upper shell 34 and lower shell 36 can interlock with each other. The interlock prevents the air duct 10 from moving in either of the first and second rotational directions. Each of the upper and lower shells 34, 36 can include tuning holes 46 that are used to control dispersion of the pressure waves coming from the air duct 10 when the engine is running. The size, location, and number of tuning holes 46 can be predetermined based on the acoustic requirements for the vehicle.

The upper shell 34 may include a plurality of latches 48 that are received by a plurality of hook members 50 formed on the lower shell 36. The plurality of latches 48 may allow the upper shell 34 and lower shell 36 to be disassembled for servicing the air duct 10 or may be designed to prevent such service if so desired. Alternatively, the upper and lower shells 34, 36 may be attached using other mechanical processes such as welding or by using another fastener, such as screws, bolts, etc.

Figure 6:
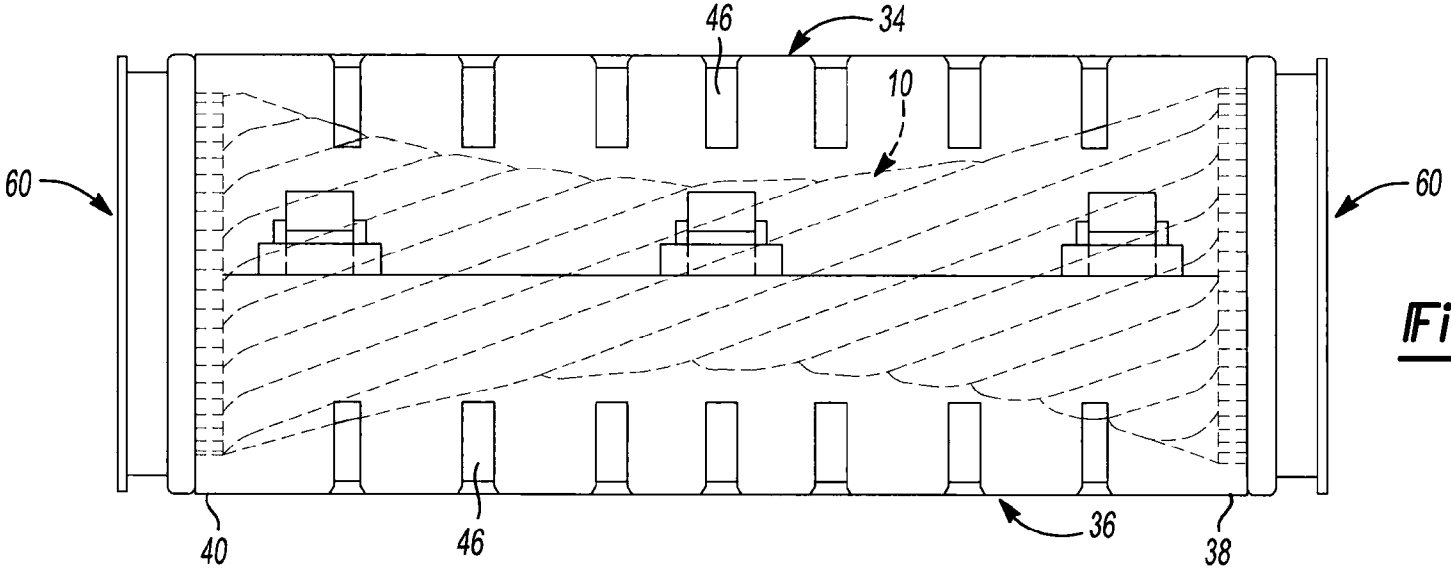
FIG. 6 is a side view of the air duct having a collar portion attached in accordance with the present teachings.

With reference to FIG. 6, a collar 60 is depicted as attached to the first end 14 of the air duct 10. Similarly, a collar 60 is shown attached to the second end 16 of the air duct 10. Each of the collars 60 can couple the air duct 10 to one of the intake portion of the engine and the air filter housing. Thus, the collars 60 provide an attachment point for a tubular air handling member or duct, and a groove for a clamp, such as a hose clamp. Each of the collars 60 may be formed using a rubber or plastic material, or any suitable material known in the art. The collars 60 can be attached to the first and second ends 14, 16 of the air duct 10 using a variety of processes such as overmolding, welding or other mechanical or chemical attachment process known in the art. Alternatively, the collars 60 can be attached to the first and second ends 14, 16 of the air duct 10 before the venturi is formed in the air duct 10.

Figure 7:
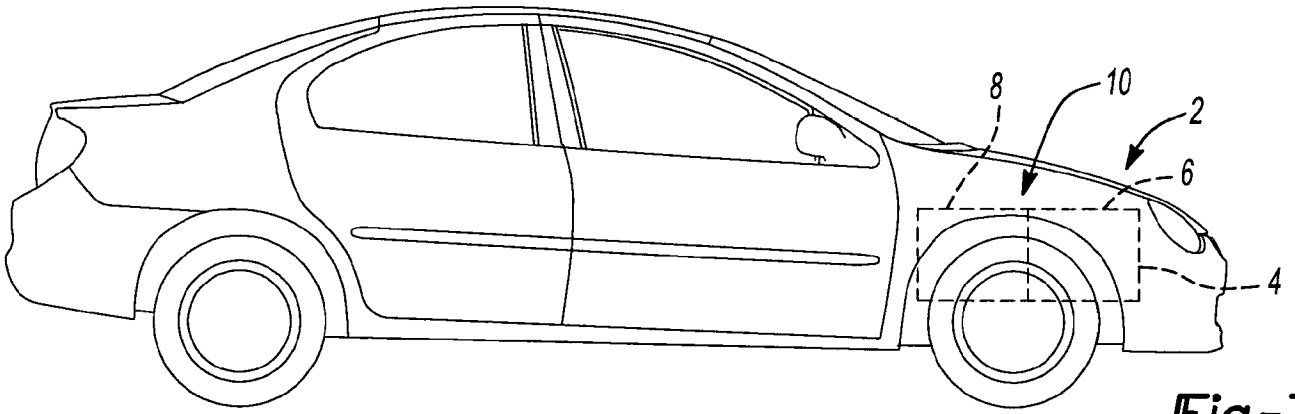
FIG. 7 depicts an example of a location of the air duct in a vehicle.

FIG. 7 depicts an example of a location of the air duct 10 in a vehicle 2. More specifically, the air duct 10 may be attached to an engine 4 as part of the fresh air intake of the engine 4. Moreover, the air duct 10 may be located between an air filter 6 and a throttle body 8 of the engine 4. Because the air duct 10 is located aft of the fresh air filter 6, with respect to air flow into the engine 4, the air duct must be sealed of outlets to any outside, unfiltered air.

Described in a slightly different manner than that disclosed above, and with reference to FIGS. 1-7, what is disclosed is an apparatus for reducing air induction noise of an air intake (e.g.

an air filter 6, throttle body 8, and air duct 10) of an engine 4 of a vehicle 2. The apparatus may employ an elongated hollow air duct 10 that is symmetrical about its longitudinal axis (FIG. 2). The air duct 10 is capable of accepting air into a first duct longitudinal end, past a midpoint duct portion 20, and out of a second duct longitudinal end. The midpoint duct portion 20 has a midpoint duct portion wall thickness less than a first duct end wall thickness and a second duct end wall thickness. The first duct end 14 may be circular and may further employ a plurality of notches 24 about an exterior periphery 22. The second duct end 16 may be circular and employ a plurality of notches 24 about its exterior periphery.

An air duct housing, such as shell 34 and shell 36, may encase the air duct 10 and employ a lower shell 36 with a lower shell first end 38 and a lower shell second end 40 and an upper shell 34 with an upper shell first end 38 and an upper shell second end 40. Each end of each shell 34, 36 may have a plurality of notches 44 about an interior periphery that mesh with the plurality of notches 44 about the exterior periphery of the first duct end 14 and the second duct end 16 to prevent rotation of the air duct 10 relative to the lower shell 36 and the upper shell 34. The lower shell 34 and the upper shell 36 further define a plurality of tuning holes 46 for tuning sound. The tuning holes 46 exhibit a plurality of diameters. The lower shell 36 may further employ a plurality of hook members 50 and the upper shell 34 may employ a plurality of latches 48 such that the plurality of hook members 50 pass into the plurality of latches 48. The air duct housing 34, 36 completely covers the outer surface 22 of the air duct 10. A transverse cross-sectional area at the midpoint duct portion 20 is less than a cross-sectional area of the first duct end 14 and the second duct end 16. FIG. 3 depicts a longitudinal cross-section of the duct 10. A cross-sectional area of the first duct end 14 and a cross-sectional area of the second duct end 16 may be equal. The air duct housing 34, 36 and the air duct 10 define an air gap or air space therebetween, within which the plurality of tuning holes reside, or rather the tuning receptacles protrude. The holes do not have to be through holes, but may be blind holes, or holes drilled or bored to a specific depth, such as for acoustical purposes.

In another configuration, the present teachings may also encompass an apparatus for reducing air induction noise of an air intake (e.g. an air filter 6, throttle body 8, and air duct 10) of an engine 4 of a vehicle 2. The apparatus may further employ an air duct housing having a lower shell 36 and an upper shell 34, the lower shell 36 having a lower shell first end 38 and a lower shell second end 40, the upper shell 34 having an upper shell first end 38 and an upper shell second end 40. The upper shell 34 and lower shell 36 may each define a plurality of tuning holes 46, which may be blind holes (counter bored) or through holes. The air duct 10 may only contact the air duct housing only at an air duct first end 38 and an air duct second end 40. The air duct 10 may have an elongated circumferential wall 12 having an interior surface and an exterior surface. The circumferential wall may define an aperture between the air duct first end and the air duct second end to permit the passage of intake air for the engine 4. The circumferential wall may define a venturi between the first end 14 and second end 16 for restricting an amount of sound passing from the first end 14 to the second end 16 of the air duct 10. The circumferential wall 12 may have a predetermined thickness that enables sound to pass through the circumferential wall and into an air gap or space between the circumferential wall and the air duct housing, and then into the air duct housing 34, 36 and its tuning holes 46. The function of the tuning holes 46, in conjunction with the venturi or reduced cross section of the duct 10, is to attenuate or reduce the noise level of the air passing through the fresh air intake of the engine 4. By reducing the level of noise heard by a person standing exterior to the vehicle 2, or within the vehicle cabin, an overall quieter vehicle 2 may be produced.

A first plurality of notches 24 may be formed on the exterior surface 22 of the circumferential wall at the air duct first end 38 and the air duct second end 40. The air duct 10 and the housing 34, 36 define an air gap therebetween. The upper shell 34 may be arcuate, the lower shell may be arcuate, and the upper shell 34 and the lower shell 36 each have a second plurality of notches 44. The first plurality of notches 24 of the circumferential wall 12 interlock with the second plurality of notches 44 of the upper shell 34 and the lower shell 36. The interlock prevents the air duct 10 from rotating relative to the shells 34, 36. The air duct 10 may further employ a first collar 60 connected to the air duct first end 38, and a second collar 60 connected to the air duct second end 40. Connection of the collars 60 may be by over molding, welding or mechanical fastener attachment.

A method of manufacturing an air intake system that reduces air induction noise may entail forming an air duct 10 including a circumferential wall 12 having an outer surface 22 and an inner surface. The circumferential wall may define an aperture formed between a first end 14 and second end 16 of the air duct 10. Manufacturing the air duct may further entail forming a first plurality of notches 24 on the outer surface of the circumferential wall 12 near the first end 14 and second end 16. The manufacturing method may further entail: elongating the air duct 10, which may be plastic, before it is cured so that the circumferential wall 12 decreases, at least in certain parts, to a second thickness that is less than the first thickness; rotating one of the first and second ends 14, 16 of the air duct 10 in a first direction to reduce the diameter of the air duct between the first and second ends 14, 16; positioning the air duct 10 in a lower housing so that the plurality of first notches 24 formed on the circumferential wall 12 interlock with a plurality of second notches 44 formed in the lower housing 36; and attaching an upper housing 34 to the lower housing 36. The other of the first and second ends 14, 16 may be rotated in a second direction to impart a twisted structural feature in the surface of the duct 10. The method may further entail attaching a first collar 60 to the first end 14 of the air duct 10 and attaching a second collar 60 to the second end 16 of the air duct 10. The first and second collars 60 may be attached to the air duct 10 after the upper and lower housings 34, 36 are attached. The first collar is flexible and may connect to a throttle body and the second collar is flexible and may connect to an air filter.

Thus, functionally, noise caused by air induction passes from the hollow chamber of the air duct 10 and through the thin wall 20 of the air duct 10. The thin wall 20 is permitted to flex and move to absorb noise. Noise that escapes the air duct 10 then passes into the air gap between the air duct 10 and the upper and lower shells 34, 36. The noise may continue into the recesses or holes 46 by passing through the wall of the shells 34, 36. Thus, the level of noise heard outside of the shells 34, 36 may be less than what would be heard if another type of duct were used, such as a straight pipe type of air duct. The air duct 10 and shells 34, 36 are sealed units to prevent dust and air from escaping from either.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An apparatus for reducing air induction noise of an air intake of an engine of a vehicle, the apparatus comprising:

an elongated monolithic hollow air duct molded from a single material, that is symmetrical about its longitudinal axis, the air duct capable of accepting air into a first duct end, past a midpoint duct portion, and out of a second duct end, wherein the midpoint duct portion has a midpoint duct portion wall thickness less than a first duct end wall thickness and a second duct end wall thickness, having a transition between the wall thickness at the first duct end and the midpoint duct portion and the second duct end and the midpoint duct portion of a gradual taper, the midpoint duct portion having more radial flexibility inward and outward from the longitudinal axis, relative to the first duct end and the second duct end, the radial flexibility decreasing gradually from the midpoint to the first duct end and the second duct end.

2. The apparatus of claim 1, wherein the first duct end is circular, the first duct end further comprising a continuous plurality of notches about an exterior periphery, said notches having depth less than the wall thickness of said first duct end; and the second duct end is circular, the second duct end further comprising a continuous plurality of notches about an exterior periphery, the notches having a depth less than the wall thickness of the second duct end.

3. The apparatus of claim 2, further comprising:

an air duct housing comprising:

a lower shell with a lower shell first end and a lower shell second end; and an upper shell with an upper shell first end and an upper shell second end, wherein each end of each shell has a plurality of notches about an interior periphery that interlock with the plurality of notches about the exterior periphery of the first duct end and the second duct end to prevent rotation of the air duct relative to the lower shell and the upper shell.

4. The apparatus of claim 3, wherein the lower shell and the upper shell further define a plurality of tuning holes having a plurality of diameters for tuning sound.

5. The apparatus of claim 4, wherein the tuning holes exhibit a plurality of diameters.

6. The apparatus of claim 5, wherein the lower shell further comprises:

a plurality of hook members.

7. The apparatus of claim 6, wherein the upper shell further comprises:

a plurality of latches, wherein the plurality of hook members pass into the plurality of latches.

8. The apparatus of claim 7, wherein the air duct housing Completely covers the outer surface of the air duct.

9. The apparatus of claim 8, wherein:

a transverse cross-sectional area at the midpoint duct portion is less than a cross-sectional area of the first duct end and the second duct end, and gradually tapers out to the cross-sectional area of the first duct end and the second duct end, and a cross-sectional area of the first duct end and a cross-sectional area of the second duct end are equal.

10. The apparatus of claim 4, wherein the air duct housing and the air duct define an air gap therebetween, within which the plurality of tuning holes reside.

11. An apparatus for reducing air induction noise of an air intake of an engine of a vehicle, the apparatus comprising:

an air duct housing having a lower shell and an upper shell, the lower shell having a lower shell first end and a lower shell second end, the upper shell having an upper shell first end and an upper shell second end, the upper shell defining a plurality of tuning holes, and the lower shell defining a plurality of tuning holes; and an air duct comprising an elongated monolithic structure molded from a single material, that is symmetrical about its longitudinal axis, that contacts the air duct housing only at an air duct first end and an air duct second end, the air duct having a circumferential wall having an interior surface and an exterior surface, the air duct having a midpoint duct portion, the midpoint duct portion having more radial flexibility inward and outward from the longitudinal axis, relative to the first duct end and the second duct end, the radial flexibility decreasing gradually from the midpoint to the first duct end and the second duct end.

12. The apparatus of claim 11, wherein:

the circumferential wall defines a longitudinal aperture between the air duct first end and the air duct second end, the circumferential wall defines a venturi between the first and second ends for restricting an amount of sound passing from the first end to the second end of the air duct, and the circumferential wall has a predetermined thickness that enables sound to pass through the circumferential wall and into the air duct housing.

13. The apparatus of claim 12, further comprising:

a continuous plurality of notches about an exterior periphery, the notches having a depth less than the wall thickness of the air duct first end; and wherein the air duct second end is circular, the air duct second end further comprising a continuous plurality of notches about an exterior periphery, the notches having a depth less than the wall thickness of the air duct second end.

14. The apparatus of claim 13, wherein:

the air duct and the housing define an air gap there between, the upper shell is arcuate, the lower shell is arcuate, and the upper shell and the lower shell each have a second plurality of notches, and the first plurality of notches of the circumferential wall interlock with the second plurality of notches of the upper shell and the lower shell, wherein the interlock prevents the air duct from rotating.

15. The apparatus of claim 14, further comprising:

a first collar connected to the air duct first end; and a second collar connected to the air duct second end.

16. An apparatus for reducing air induction noise of an air intake of an engine of a vehicle, the apparatus comprising:

an air duct housing having a lower shell and an upper shell, the lower shell having a lower shell first end and a lower shell second end, the upper shell having an upper shell first end and an upper shell second end, the upper shell defining a plurality of tuning holes, and the lower shell defining a plurality of tuning holes;

an air duct comprising an elongated monolithic structure molded from a single material, that is symmetrical about its longitudinal axis, that contacts the air duct housing only at an air duct first end and an air duct second end, the air duct having a circumferential wall having an interior surface and an exterior surface, the air duct having a midpoint duct portion, the midpoint duct portion having more radial flexibility inward and outward from the longitudinal axis, relative to the first duct end and the second duct end, the radial flexibility decreasing gradually from the midpoint to the first duct end and the second duct end, wherein:

the air duct and the housing define an air gap there between, the circumferential wall defines an aperture between the air duct first end and the air duct second end, the circumferential wall defines a venturi between the first and second ends for restricting an amount of sound passing from the first end to the second end of the air duct, and the circumferential wall has a predetermined thickness, the predetermined thickness being smaller at the midpoint duct portion than the air duct first end and the air duct second end, with a gradual taper from the thickness at said midpoint to the air duct first end and the air duct second end, the midpoint duct portion having more radial flexibility inward and outward from the longitudinal axis, relative to the first duct end and the second duct end, the radial flexibility decreasing gradually from the midpoint to the first duct end and the second duct end, that enables sound to pass through the circumferential wall and into the air duct housing.

17. The apparatus of claim 16, further comprising:

a first plurality of continuous notches formed on the exterior surface of the circumferential wall at the air duct first end and the air duct second end, the notches having a depth less than the wall thickness of the air duct first end and the air duct second end.

18. The apparatus of claim 17, wherein:

the upper shell is arcuate, the lower shell is arcuate, and the upper shell and the lower shell each have a second plurality of notches, and the first plurality of notches of the circumferential wall interlock with the second plurality of notches of the upper shell and the lower shell, wherein the interlock prevents the air duct from rotating.

19. The apparatus of claim 18, further comprising:

a first collar connected to the air duct first end; and a second collar connected to the air duct second end, wherein the first collar is flexible and connects to a throttle body and the second collar is flexible and connects to an air filter.

* * * * *